US007331285B2

(12) United States Patent
Steenkamer et al.

(10) Patent No.: US 7,331,285 B2
(45) Date of Patent: Feb. 19, 2008

(54) SQUEEGEE UNIT FOR A ROTARY SCREEN-PRINTING DEVICE

(75) Inventors: Arnoldus Theodorus Steenkamer, Oostrum (NL); Dirk Steenbeek, Lunteren (NL)

(73) Assignee: Stork Prints B.V., Boxmeer (NL)

( * ) Notice: Subject to any disclaimer, the term of this patent is extended or adjusted under 35 U.S.C. 154(b) by 229 days.

(21) Appl. No.: 10/521,893

(22) PCT Filed: Jul. 23, 2003

(86) PCT No.: PCT/NL03/00537

§ 371 (c)(1),
(2), (4) Date: Jan. 19, 2005

(87) PCT Pub. No.: WO2004/009359

PCT Pub. Date: Jan. 29, 2004

(65) Prior Publication Data

US 2006/0086268 A1 Apr. 27, 2006

(30) Foreign Application Priority Data

Jul. 23, 2002 (NL) ..... 1021133
Feb. 25, 2003 (NL) ..... 1022774

(51) Int. Cl.
*B41L 13/00* (2006.01)

(52) U.S. Cl. ..... 101/120; 101/116; 101/169

(58) Field of Classification Search ..... 101/119, 101/120, 123, 124, 155–157, 167–169
See application file for complete search history.

(56) References Cited

U.S. PATENT DOCUMENTS 3,878,780 A * 4/1975 Lotte ..... 101/119
3,949,666 A 4/1976 Zimmer
4,232,601 A * 11/1980 Mitter ..... 101/120
4,638,733 A 1/1987 Schneider et al.

FOREIGN PATENT DOCUMENTS

EP 0 011 314 A1 5/1980

* cited by examiner

*Primary Examiner*—Ren Yan
(74) *Attorney, Agent, or Firm*—Hoffmann & Baron LLP

(57) ABSTRACT

A squeegee unit for a rotary screen-printing device comprises a squeegee (2) with a squeegee edge (3) which is designed, during operation of a rotary screen-printing device in which the squeegee unit is mounted, to be pressed onto the inner side of a cylindrical screen of the rotary screen-printing device, and a squeegee holder (1) in which the squeegee is mounted. The squeegee edge (3) can be moved away from the squeegee holder (1) and towards the squeegee holder. A resilient element (18) is arranged between the squeegee edge (3) and the squeegee holder (1), in such a manner that the squeegee edge is pressed away from the squeegee holder by spring force. The squeegee unit is provided with travel-limiting means which are designed in such a manner that the squeegee edge (3) can be moved over a relatively short distance of at most 1 mm and preferably of at most 0.5 from the working position in a direction away from the squeegee holder.

20 Claims, 7 Drawing Sheets

SQUEEGEE UNIT FOR A ROTARY SCREEN-PRINTING DEVICE

Figure 1:
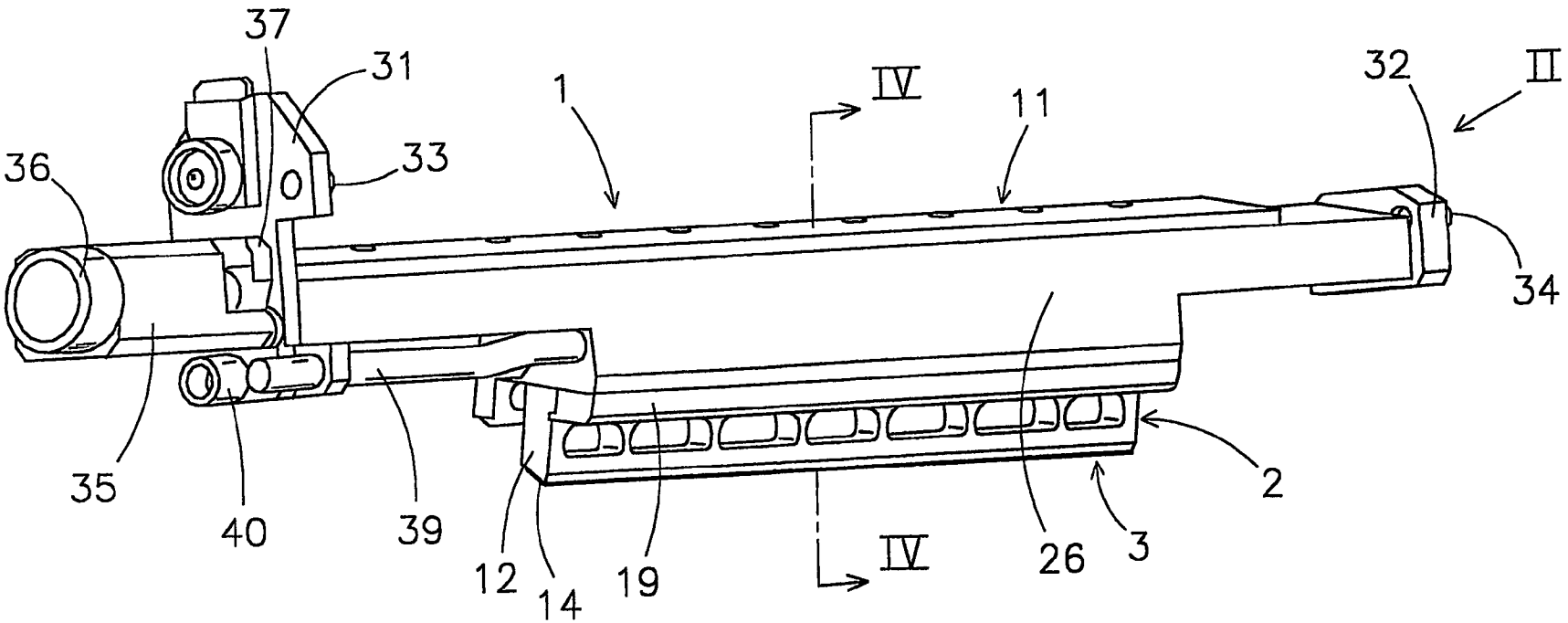

CROSS-REFERENCE TO RELATED APPLICATIONS:

This application is the National Stage of International Application No. PCT/NL2003/000537, filed Jul. 23, 2003, which claims the benefit of Netherlands Application Nos. NL 1021133, filed Jul. 23, 2002, and NL 1022774, Filed Feb. 25, 2003, the contents of which is incorporated by reference herein.

FIELD OF THE INVENTION

The invention relates to a squeegee unit for a rotary screen-printing device, comprising a blade squeegee, with a squeegee edge which is designed, during operation of a rotary screen-printing device in which the squeegee unit is mounted, to be pressed against the inner side of a cylindrical screen of the rotary screen-printing device, and a squeegee holder to which the squeegee is fastened, it being possible for the squeegee edge to be moved away from the squeegee holder and towards the squeegee holder, and a resilient element being arranged between the squeegee edge and the squeegee holder, in such a manner that the squeegee edge can be pressed towards the squeegee holder counter to spring force.

BACKGROUND OF THE INVENTION

A squeegee unit of this type is known in practice in various designs. A design which is in widespread use is one in which the squeegee comprises an elongate metal squeegee blade and an edge strip which is fitted to it in the longitudinal direction, forms the squeegee edge and is made from an elastomer material with a hardness which is such that unevenness in the material to be printed can be overcome. The squeegee blade is clamped in the squeegee holder at the opposite longitudinal side from the squeegee edge. The squeegee blade is resilient and is responsible for positioning the squeegee edge and transmitting force from the squeegee holder to the squeegee edge. During operation of a rotary screen-printing device in which the squeegee unit is mounted, the squeegee holder is positioned in such a manner that the squeegee edge is pressed onto the inner side of the cylindrical screen with a defined prestress, the resilient squeegee blade being deformed slightly. In a rotary screen-printing device, an element which provides a counterpressure, for example a counterpressure roll, is present opposite the squeegee edge on the outer side of the cylindrical screen.

The known squeegee unit has the drawback that in a situation in which the squeegee edge is pressed onto the inner side of the cylindrical screen, the counterpressure disappears, the squeegee edge can excessively deform the cylindrical screen and thereby damage it. Examples in which the counterpressure may disappear are:

when a rotary screen-printing device is integrated in an intaglio printing or offset sheet-fed rotary printing machine, the counterpressure roll of which in the axial direction has a gap for retaining/positioning the substrate which is to be printed. The counterpressure disappears at the location of the gap.

when a rotary screen-printing device is integrated in a semi-rotary flexographic, letterpress or offset printing press, in which case the substrate web which is to be printed has to be free from contact from any printing system during part of the printing cycle so that it can be positioned for the next printing cycle, but at the start of the new printing cycle all the squeegee settings required have to be available immediately.

in the case of a rotary screen-printing device for treating (printing) discrete substrates with a considerable thickness, as described, for example, in EP 0 974 458 A1. In this case, a counterpressure roll does not necessarily have to be present. The substrates themselves, lying on a conveyor system, supply the counterpressure. The counterpressure disappears at the edges of the substrates.

SUMMARY OF THE INVENTION

It is an object of the invention to provide a squeegee unit of the type described in the introduction which does not have the abovementioned drawback.

This object is achieved by a squeegee unit for a rotary screen-printing device, comprising a blade squeegee, with a squeegee edge which is designed, during operation of a rotary screen-printing device in which the squeegee unit is mounted, to be pressed against the inner side of a cylindrical screen of the rotary screen-printing device, and a squeegee holder to which the squeegee is fastened, it being possible for the squeegee edge to be moved away from the squeegee holder and towards the squeegee holder, and a resilient element being arranged between the squeegee edge and the squeegee holder, in such a manner that the squeegee edge can be pressed towards the squeegee holder counter to spring force, characterized in that the squeegee unit is provided with travel-limiting means which are designed in such a manner that the squeegee edge can move over a relatively short distance from the working position in the direction away from the squeegee holder.

When the squeegee unit according to the invention is used in a rotary screen-printing device, the squeegee holder can be set in such a manner with respect to the cylindrical screen that the squeegee edge is pressed onto the inner side of the cylindrical screen with a predetermined force, but that when the counterpressure disappears the squeegee edge only moves over a relatively short distance, thus preventing the cylindrical screen from being excessively deformed or damaged by the squeegee edge.

The distance over which the the squeegee edge can move is at most 1 mm. This distance is preferably at most 0.5 mm.

Further embodiments of the squeegee unit according to the invention are defined in the dependent claims.

BRIEF DESCRIPTION OF THE INVENTION

Figure 2:
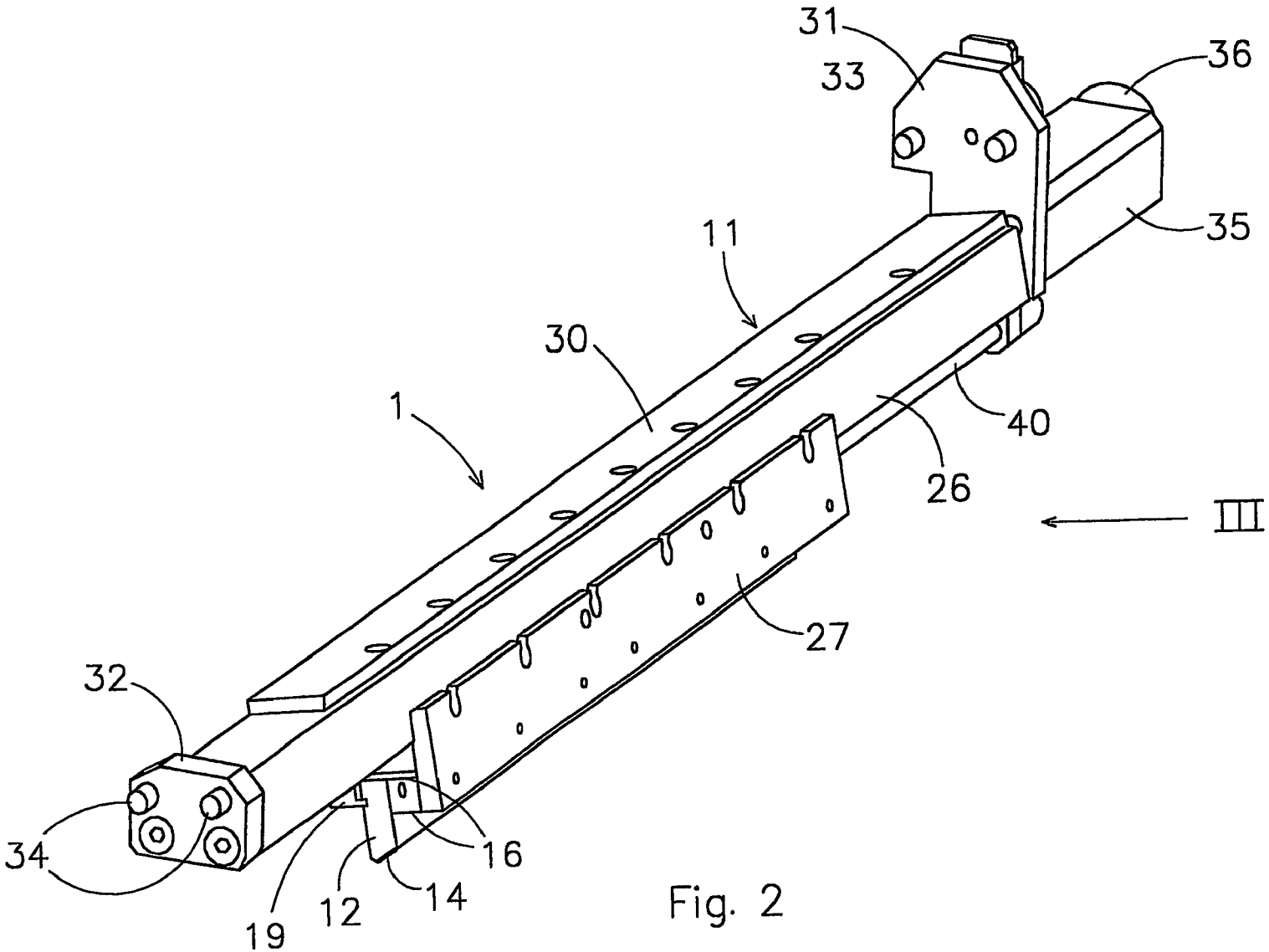
Figure 3:
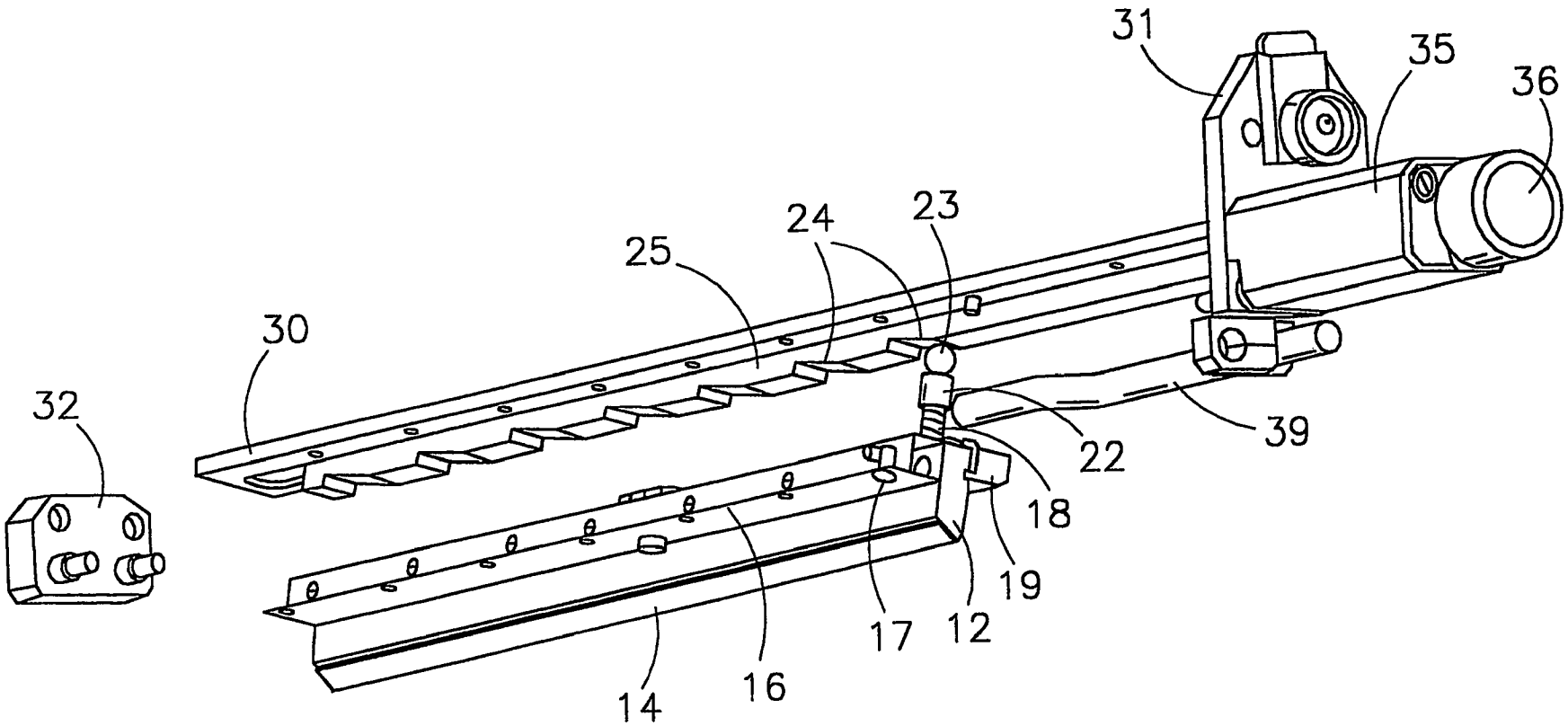
Figure 4:
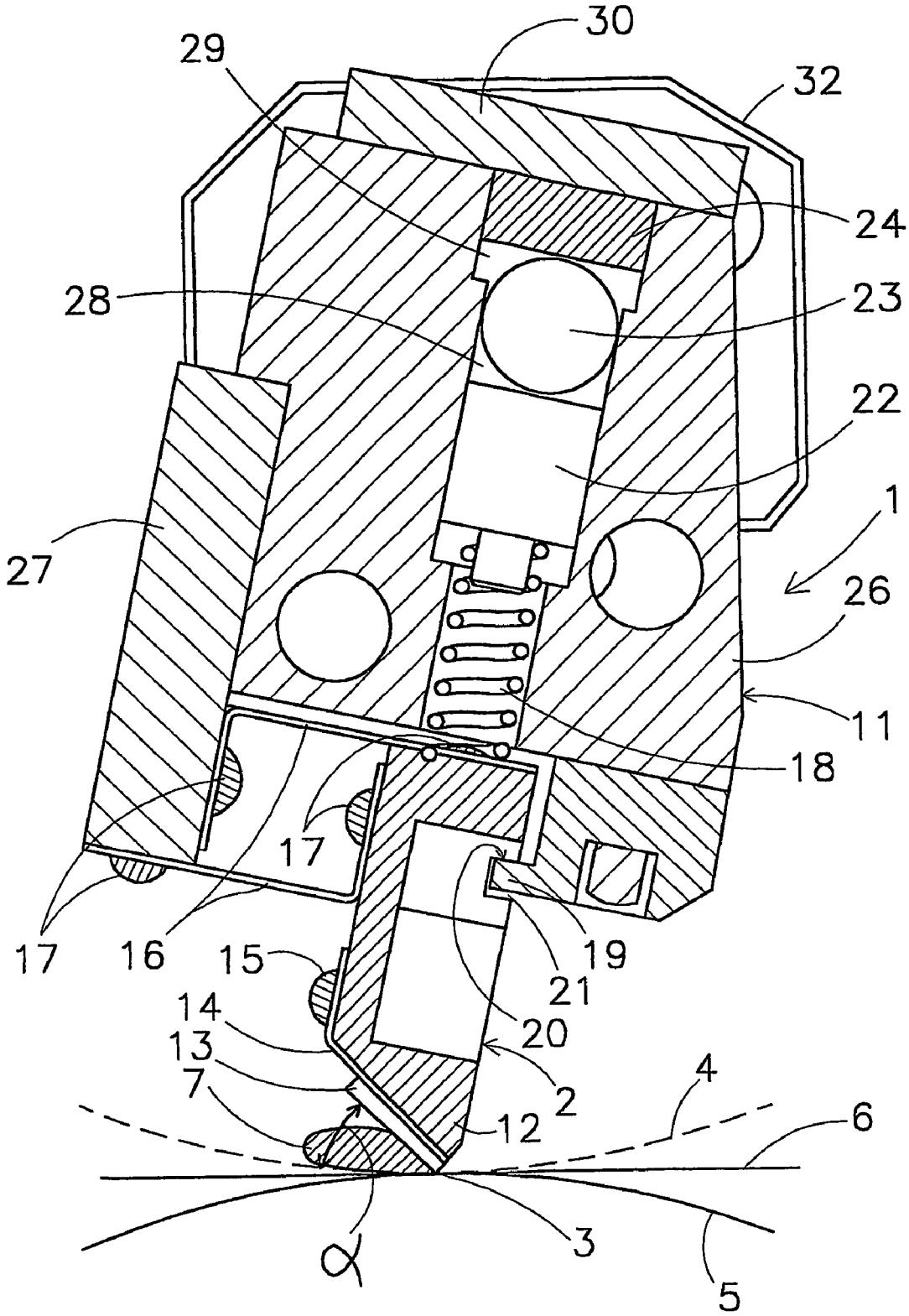

The invention will be explained in the following description of a number of embodiment of the squeegee unit with reference to the drawing, in which:

FIG. 1 shows a perspective view of a specific embodiment of the squeegee unit according to the invention, FIG. 2 shows a perspective view of the squeegee unit from FIG. 1, seen from the other side in the direction of arrow II in FIG. 1, FIG. 3 shows a perspective view of a number of components of the squeegee unit shown in FIG. 1, seen in the direction of arrow III in FIG. 2, and FIG. 4 shows a cross section through the squeegee unit shown in FIG. 1 on line IV-IV in FIG. 1.

Figure 5:
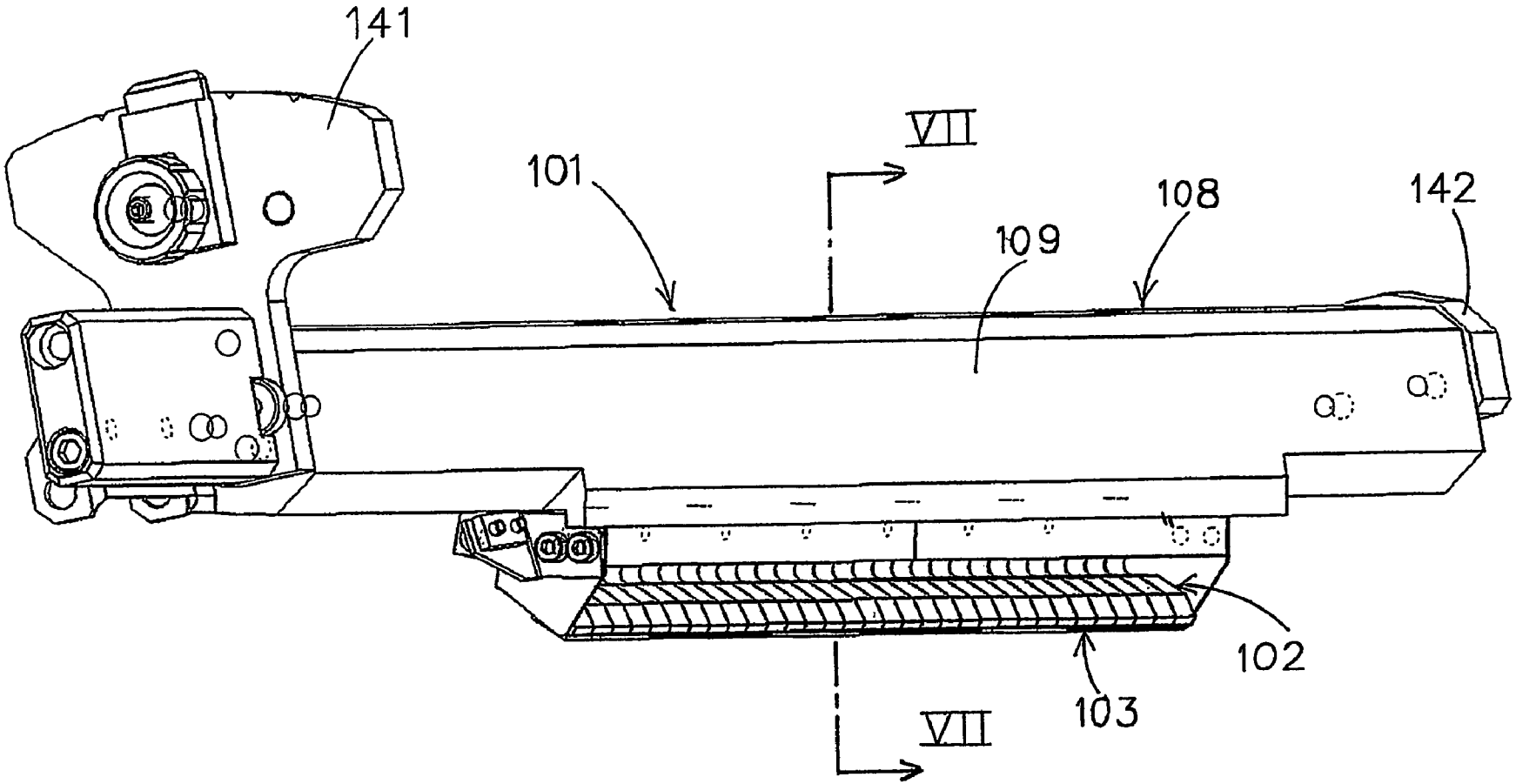
Figure 6:
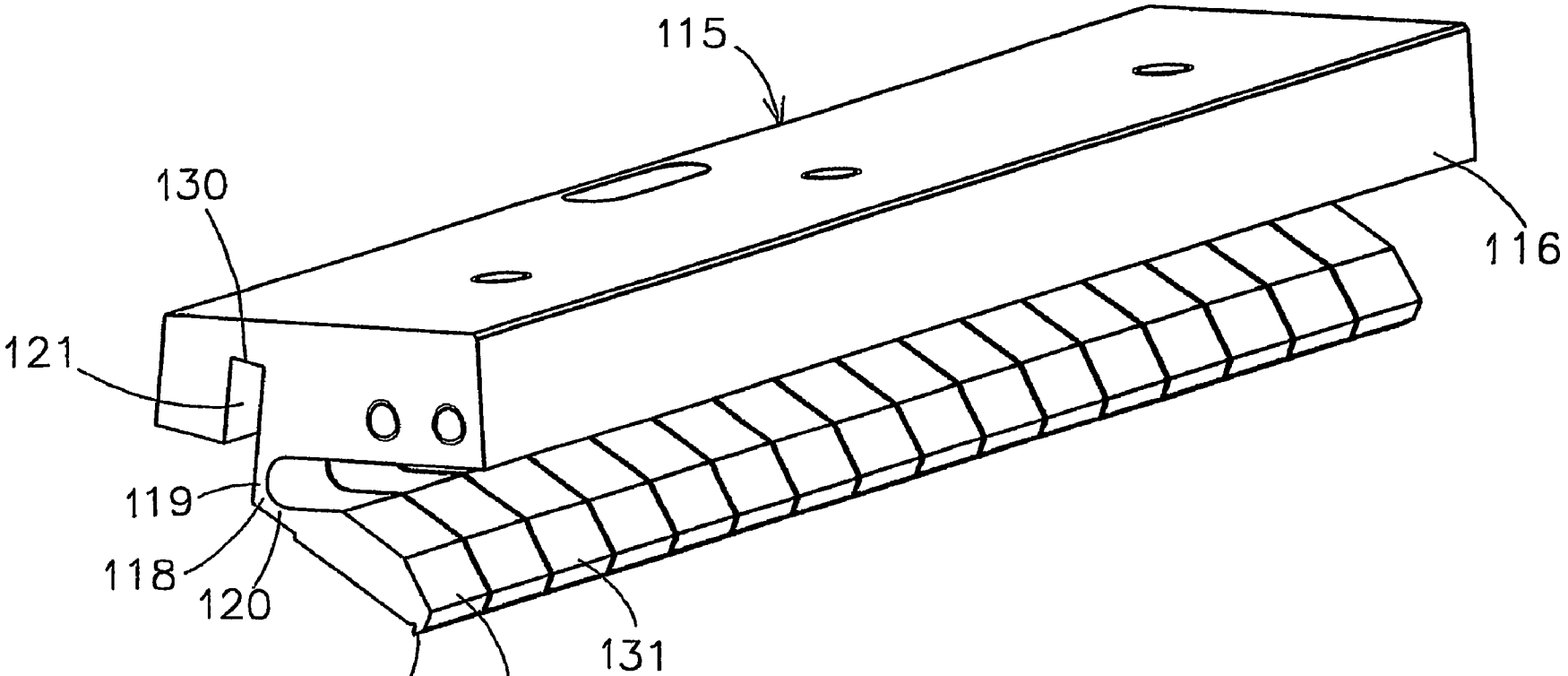
Figure 7:
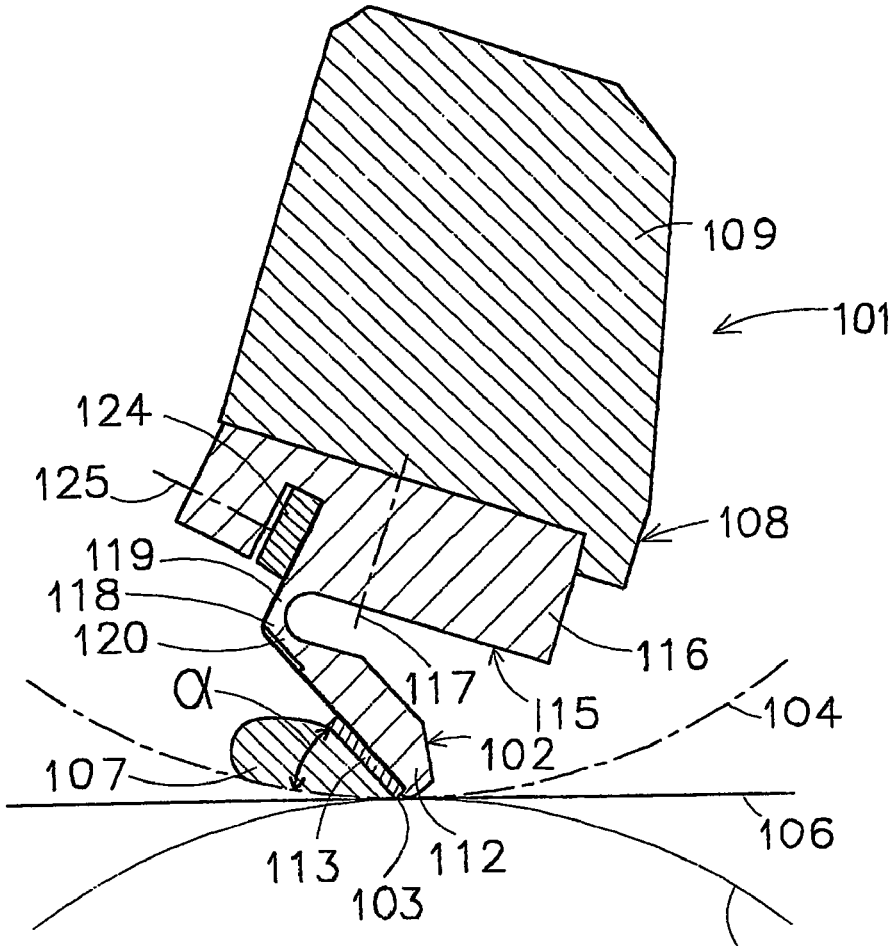
Figure 8:
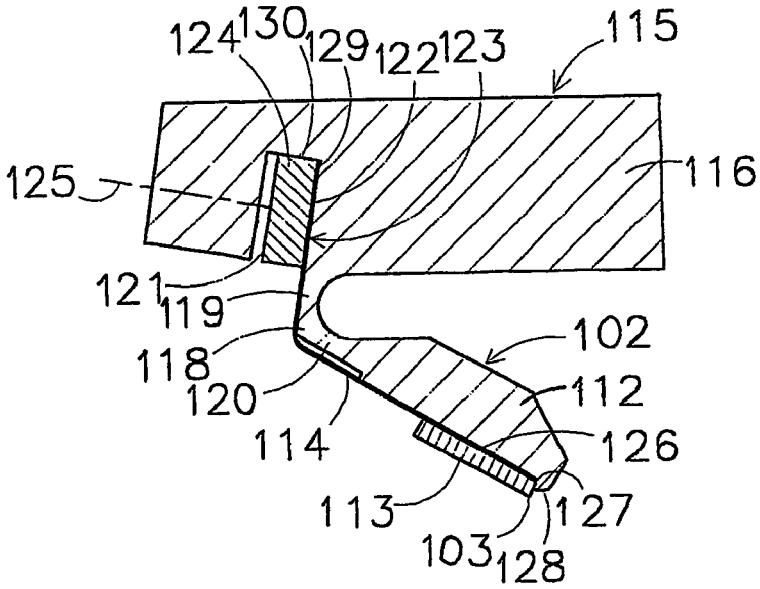

FIG. 5 shows a perspective view of another embodiment of the squeegee unit according to the invention, FIG. 6 shows a perspective view of the squeegee blade holder of the squeegee unit shown in FIG. 5, FIG. 7 shows a cross section through the squeegee unit shown in FIG. 5 on line III-III in FIG. 5, and FIG. 8 shows a cross section, on an enlarged scale, through the squeegee blade holder with squeegee blade.

DETAILED DESCRIPTION OF PREFERED EMBODIMENTS

FIGS. 1-4 illustrate a first embodiment of a squeegee unit according to the invention. The squeegee unit is denoted overall by reference number 1. The squeegee unit comprises a squeegee 2 with a squeegee edge 3 which is designed to press against the inner side of a cylindrical screen 4, which is diagrammatically depicted in FIG. 4, of a rotary screen-printing device in which the squeegee unit 1 is mounted during operation of the rotary screen-printing device. In this example, the desired counterpressure is supplied by a diagrammatically indicated counterpressure roll 5. The substrate 6 which is to be printed advances between the cylindrical screen 4 and counterpressure roll 5. The printing paste which is forced through the cylindrical screen 4 by the squeegee 2 at the location of the squeegee edge 3 is denoted by reference numeral 7. The counterpressure can in other applications also be supplied by rigid, discrete substrates which are supplied lying on a flat conveyor system.

The squeegee unit 1 also comprises a squeegee holder 11 to which the squeegee 2 is secured. A rigid squeegee holder beam 26 forms the basis for the squeegee holder 11.

The squeegee 2 is formed by an elongate, rigid squeegee bar in the form of a squeegee support profile 12 and an edge strip 13, which is secured to the squeegee support profile 12, forms the squeegee edge 3 and is made from slightly flexible material, for example an elastomer material, such as polyurethane, which a hardness which is such that unevenness in the material to be printed can be overcome. The edge strip 13 is arranged on a squeegee blade 14 which in turn is secured to the squeegee support profile 12 and thereby bears taut against the squeegee support profile 12. The squeegee blade 14 is secured to the squeegee support profile 12 by means of bolts 15 or other suitable securing means (cf. FIG. 4).

The squeegee support profile 12 is secured to the squeegee holder 11 by means of a set of parallel leaf springs 16 which act transversely to the longitudinal direction of the squeegee support profile 12. The leaf springs 16 are secured, by means of bolts 17 or other suitable securing means, on one side to the squeegee support profile 12 and on the other side to a bar 27 secured to the squeegee holder beam 26. On account of the use of leaf springs 16, the squeegee support profile 12 can in principle move parallel to itself away from the squeegee holder 11 and towards the squeegee holder 11. The movement is in principle free of hysteresis.

The squeegee 2 is pressed away from the squeegee holder 11 by means of one or more compression springs 18 arranged between the squeegee 2 and the squeegee holder 11. The movement of the squeegee 2 in the direction away from the squeegee holder 11 is limited by travel-limiting means which are formed by a travel limiter 19 arranged on the squeegee holder beam 26 and a stop 20, which is arranged in the squeegee support profile 12, interacts with the travel limiter 19 and is formed by the edge of a recess 21 formed in the squeegee support profile 12. The travel limiter 19 engages in the recess 21.

The compression spring or springs 18 ensure that the squeegee edge 3 is pressed against the inner side of the cylindrical screen 4 with a predetermined force during operation of a rotary screen-printing device in which the squeegee unit is mounted. When the counterpressure disappears, the stop 20 will come into contact with the travel limiter 19. Under the influence of the spring force of the compression spring or springs 18, the stop 20 is then pressed onto the stop limiter 19 with a predetermined prestress.

The travel limiter 19 and the stop 20 are designed in such a manner that when the counterpressure disappears the squeegee edge 3 can only move over a distance of at most 1 mm and preferably over a distance of at most 0.5 mm from the working position. In practice, the distance over which the squeegee edge can move is approx. 0.3 mm.

The spring force of each compression spring 18 can be adjusted by means of a spring support 22, which bears against the opposite end of the compression spring 18 from the squeegee support profile 12 and the position of which is adjustable in the working direction of the compression spring 18. The position of the spring support 22 can be adjusted by virtue of the fact that the spring support 22 is supported on a ball 23 which is guided in the squeegee holder beam 26 and is in turn supported on a wedge-shaped ball support 24 which can be displaced transversely to the working direction of the compression spring 18. The compression spring 18, the spring support 22 and the ball 23 are accommodated in a bore 28 formed in the squeegee holder beam 26. If a plurality of compression springs 18 are used, the wedge-shaped ball supports 24 may be mounted on or form part of an elongate sliding bar 28 which is guided in a slot 29 in the longitudinal direction in the squeegee holder beam 26 (cf. FIG. 3). On the side remote from the balls 23, the sliding bar 25 is supported by a closure bar 30 secured to the squeegee holder beam 26.

Mounting supports 31 and 32, by means of which the squeegee holder 11 can be mounted in a rotary screen-printing device (not shown), are secured at the ends of the squeegee holder 11. The mounting supports 31 and 32 are provided with holding pins 33 and 34 which engage in curved holding slots which are arranged in those parts of the rotary screen-printing device which bear the squeegee unit 1.

The squeegee holder 11 can rotate with respect to the parts which bear the squeegee unit 1, about its longitudinal axis, by displacement of the holding pins 33 and 34 in the curved holding slots, so that the squeegee angle $\alpha$, i.e. the angle between the edge strip 13 which forms the squeegee edge 3 and the cylindrical screen 4 (cf. FIG. 4), can be adjusted, independently of the setting of the compressive force of the compression spring or springs 18.

A handle 35, which also acts as a guide block, is secured to the mounting support 31. On the handle 35 there is a button 36 which can be used to set the squeegee pressure by displacement of the slide 25 together with the ball supports 24. The squeegee pressure which is set can be read out via an indicator 37 arranged on the handle 35.

FIGS. 1-3 also show a pipe 39 for supplying ink or printing paste and a pipe 40 for controlling the level of the ink or printing paste.

FIGS. 5-8 illustrate a second embodiment of a squeegee unit according to the invention. The squeegee unit is also elongate and is denoted overall by reference number 101. The squeegee unit comprises a blade squeegee 102 with a squeegee edge 103 which is designed to press against the inner side of a cylindrical screen 104, which is diagrammatically depicted in FIG. 7, of a rotary screen-printing device in which the squeegee unit 101 is mounted during operation of the rotary screen-printing device. In this example, the desired counterpressure is supplied by a diagrammatically indicated counterpressure roll 105. The substrate 106 which is to be printed advances between the cylindrical screen 104 and counterpressure roll 105. The printing paste which is forced through the cylindrical screen 104 by the blade squeegee 102 at the location of the squeegee edge 103 is denoted by reference numeral 107. The counterpressure can in other applications also be supplied by rigid, discrete substrates which are supplied lying on a flat conveyor system.

The squeegee unit 101 also comprises a squeegee holder 108 to which the blade squeegee 102 is secured. A rigid squeegee holder beam 109 forms the basis for the squeegee holder 108.

As can be seen from FIGS. 7 and 8, the blade squeegee 102 is formed by an elongate squeegee bar which is formed by a squeegee support profile 112 and an edge strip 113 which is secured to the squeegee support profile 112, forms the squeegee edge 103 and is made from slightly flexible material, for example an elastomer material, such as polyurethane, with a hardness which is such that it can overcome unevenness in the material which is to be printed. In the embodiment shown, the edge strip 113 is arranged on a squeegee blade 114, which, in the region of the edge strip 113, bears taut against the squeegee support profile 112.

The squeegee support profile 112 forms part of a squeegee blade holder 115 which also comprises a bar 116 which is secured to the squeegee holder beam 109 by means of bolts 117 (diagrammatically indicated in FIG. 7) or other suitable securing means. The squeegee support profile 12 is at an angle with respect to the bar 116.

The squeegee support profile 112 is secured to the bar 116 via a relatively thin intermediate part 118 which forms one or more spring hinges. In the embodiment shown, the intermediate part 118 forms two spring hinges 119 and 120 positioned close together. These spring hinges 119 and 120 make it possible for the squeegee support profile 112 to be slightly movable with respect to the bar 116. The spring characteristic of the spring hinges 119 and 120 is steep, i.e. the spring hinges are stiff and a considerable force is required to move the squeegee support profile 112 only a short distance towards the bar 116.

For vertical displacement of the squeegee edge 103 with respect to the squeegee holder 108 (vertical squeegee edge displacement) of 0.1 mm, a force of 0.1-1.0 N, preferably 0.4-0.8 N and in particular 0.6 N is required per millimetre of width of the blade squeegee 102. For comparison purposes, it can be stated that in the case of a squeegee unit according to the prior art in which the squeegee blade is clamped in the squeegee holder on the opposite longitudinal side from the squeegee edge, under the influence of the same force the squeegee edge is lifted by approximately 10 mm.

The whole of blade squeegee 102 with spring hinges 119 and 120 is designed in such a manner that when the counterpressure disappears the squeegee edge 3 can only move over a distance of at most 1 mm and preferably over a distance of at most 0.5 mm from the working position. In practice, the distance over which the squeegee edge can move is approx. 0.3 mm.

In addition to the connection of the intermediate part 118 to the bar 116, a slot 121 which is rectangular in cross section and extends in the longitudinal direction of the strip 116 is also arranged in the strip 116.

The squeegee blade 114 is elongate and approximately L-shaped in cross section. The squeegee blade 114 is secured to the squeegee blade holder 115 by the longitudinal edge region 122 of the squeegee blade 114 on the opposite side from the edge strip 113 being clamped securely in the slot 121 against a side wall 123 of the slot 121 by means of a clamping bar 124 and bolts 125 (diagrammatically indicated) which are screwed into the strip 116 and press against the clamping bar 124. That section 126 of the squeegee blade 114 on which the edge strip 113 is arranged bears taut against the squeegee support profile 112.

The squeegee blade 114 is accurately positioned with respect to the squeegee blade holder 115 by virtue of the fact that the longitudinal edge 127 of the squeegee blade 114 which is located next to the edge strip 113 bears against a projection 128 on the edge of the squeegee support profile 112. In addition, it is also possible for the other longitudinal edge 129 of the squeegee blade 114 to bear against the base 130 of the slot 121 in the bar 116, but this is not absolutely necessary.

In the embodiment shown, the squeegee support profile 112 is divided in the longitudinal direction into a plurality of segments 131 which are located close together (cf. FIG. 6). The segments 131 are identical to one another. Dividing the squeegee support profile into segments has the advantage that for a specific setting of the squeegee unit 101 for varying substrate widths, the squeegee edge 103 always exerts substantially the same compressive force per millimetre of substrate width which is to be printed. It should be noted that the squeegee blade 114 which bears against the segments 131 is continuous, so that edge effects are evened out during printing.

It will be clear that, in view of the relatively high stiffness of the spring hinges 119 and 120, high demands are imposed on the accuracy of the dimensions of the blade squeegee 102, in particular on the consistency of the dimensions in cross section over the width of the squeegee 102.

Attachment supports 141 and 142, by means of which the squeegee holder 8 can be mounted in a rotary screen-printing device (not shown), are secured to the ends of the squeegee holder 108.

The squeegee unit 101 can rotate about the squeegee edge 103 in order to adjust the squeegee angle $\alpha$, i.e. the angle between the edge strip 113, which forms the squeegee edge 103 and the cylindrical screen 104 (cf. FIG. 7). With the geometry of the blade squeegee 102 according to the invention, the clear height of the blade squeegee 102 for a specific vertical compressive force (per millimetre of squeegee width) is independent of the squeegee angle $\alpha$.

What is claimed is:

1. Squeegee unit for a rotary screen-printing device, comprising a squeegee with a squeegee edge which is designed, during operation of a rotary screen-printing device in which the squeegee unit is mounted, to be pressed against the inner side of a cylindrical screen of the rotary screen-printing device, and a squeegee holder to which the squeegee is fastened, it being possible for the squeegee edge to be moved away from the squeegee holder and towards the squeegee holder, and a resilient element being arranged between the squeegee edge and the squeegee holder, in such a manner that the squeegee edge is pressed away from the squeegee holder by spring force, said squeegee unit further being provided with a stop which is designed in such a manner that the squeegee can only move over a relatively short distance from the working position in the direction away from the squeegee holder till the squeegee abuts against the stop.

2. The squeegee unit of claim 1, in which the squeegee edge can move over a distance of at most 1 mm and preferably over a distance of at most 0.5 mm from the working position.

3. The squeegee unit of claim 1, in which the squeegee edge, in the limit position of the squeegee edge defined by the stop, is under a prestress which is supplied by the resilient element and is directed away from the squeegee holder.

4. The squeegee unit of claim 3, in which the level of the prestress is adjustable.

5. The squeegee unit of claim 3, in which the squeegee is formed by at least one elongate, rigid squeegee bar which is provided with a squeegee edge directed away from the squeegee holder and which can move transversely to its longitudinal direction with respect to the squeegee holder, in which the resilient element is formed by at least one compression spring arranged between the squeegee bar and the squeegee holder, and in which a travel-limiting means is formed by a travel limiter arranged on the squeegee holder and the stop which is arranged on or in the squeegee bar and interacts with the travel limiter.

6. The squeegee unit of claim 5, in which the stop is formed by the edge of a recess which is formed in the squeegee bar and in which the travel limiter engages.

7. The squeegee unit of claim 5, in which the squeegee bar is secured to the squeegee holder by means of a set of parallel leaf springs which act transversely to the longitudinal direction of the squeegee bar.

8. The squeegee unit of claims 5, in which the squeegee bar is composed of at least one elongate squeegee support profile and an edge strip which is secured to the squeegee support profile, forms the squeegee edge and is made from slightly flexible material.

9. The squeegee unit of claim 8, in which the edge strip is arranged on a squeegee blade which in turn is secured to the squeegee support profile and thereby bears taut against the squeegee support profile.

10. The squeegee unit of claims 5, in which the prestress of the at least one compression spring is adjustable by means of a spring support which bears against the opposite end of the compression spring from the squeegee bar and the position of which is adjustable in the working direction of the compression spring.

11. The squeegee unit of claim 10, in which the position of the spring support is adjustable by virtue of the fact that the spring support is supported on a ball which is guided in the squeegee holder and is in turn supported on a wedge-shaped ball support which can be displaced transversely to the working direction of the compression spring.

12. The squeegee unit of claim 11, provided with two or more compression springs, each with an associated spring support, ball and wedge-shaped ball support, the ball supports being mounted on or forming part of an elongate sliding bar which is guided in the longitudinal direction of the squeegee holder.

13. The squeegee unit of claim 1, in the squeegee is formed by at least one elongate squeegee bar which is designed to be rigid in cross section and is secured to the squeegee holder via at least one spring hinge with high stiffness.

14. The squeegee unit of claim 13, in which the squeegee bar is composed of at least one elongate squeegee support profile and a squeegee strip which is secured to the squeegee support profile, forms the squeegee edge and is made from slightly flexible material.

15. The squeegee unit of claim 14, in which the edge strip is arranged on a squeegee blade which bears taut against the squeegee support profile.

16. The squeegee unit of claim 15, in which the squeegee support profile is divided in the longitudinal direction into segments positioned close together.

17. The squeegee unit of claim 14, in which the squeegee support profile forms an integral part with an elongate bar which forms part of the squeegee holder, and in which the spring hinge is formed by an intermediate part which is located between the squeegee support profile and the elongate bar and has a thickness which is less than the thickness of the squeegee support profile.

18. The squeegee unit of claim 14, in which the squeegee blade is elongate and in cross section is approximately L-shaped, and in which that longitudinal edge region of the squeegee blade which is positioned opposite the edge strip is clamped into a slot in the elongate bar, and that section of the squeegee blade on which the edge strip is arranged bears taut against the squeegee support profile.

19. The squeegee unit of claim 18, in which the squeegee blade is positioned with respect to the squeegee support profile by virtue of the longitudinal edge of the squeegee blade located next to the edge strip bearing against a projection on the edge of the squeegee support profile.

20. The squeegee unit of claim 13, in which the stiffness of the hinge spring is such that for a vertical displacement of the squeegee edge with respect to the squeegee holder of 0.1 mm, a force of 0.1-1.0 N, preferably 0.4-0.8 N and in particular 0.6 N is required per millimeter of squeegee width.

* * * * *